United States Patent [19]

Thornley

[11] 3,944,955

[45] Mar. 16, 1976

[54] SOLENOID SWITCHES

[75] Inventor: Derek Thornley, Nelson, England

[73] Assignee: Lucas Electrical Company Limited, Birmingham, England

[22] Filed: July 26, 1973

[21] Appl. No.: 382,851

[30] Foreign Application Priority Data

July 26, 1972 United Kingdom ..... 34869/72

[52] U.S. Cl. ..... 335/61; 335/200; 335/240

[51] Int. Cl. ..... H01h 7/03

[58] Field of Search ..... 335/59, 61, 62, 239, 240, 335/200; 200/83 L

[56] References Cited

UNITED STATES PATENTS

| | | | |
|---|---|---|---|
| 1,604,669 | 10/1926 | Valkenburg | 335/61 |
| 2,397,219 | 3/1946 | Taliaferro | 335/59 |
| 2,627,919 | 2/1953 | Lindahl | 335/61 |
| 3,209,180 | 9/1965 | Doyle | 335/239 |
| 3,411,117 | 11/1968 | Jencks et al | 200/83 L |
| 3,711,797 | 1/1973 | Flanagan | 335/61 |

*Primary Examiner*—Harold Broome

*Attorney, Agent, or Firm*—Holman & Stern

[57] ABSTRACT

A solenoid switch, particularly but not exclusively for use in a starter motor supply circuit includes a solenoid coil and at least one fixed contact. An armature is movable relative to the coil in response to energisation of the coil and carries a movable contact. The movable contact is urged by resilient means to a rest position relative to the armature and a member is coupled to the armature through said resilient means for movement with the armature in a direction to engage the movable contact with the fixed contact. The switch further includes a delay unit for slowing movement of the member in the contact engaging direction, the arrangement being such that in use when the movable contact engages the fixed contact the armature moves relative to the member and the movable contact compressing said resilient means and thereby increasing the pressure between the contacts.

5 Claims, 2 Drawing Figures

SOLENOID SWITCHES

This invention relates to solenoid switches, particularly but not exclusively for use in starter motor supply circuits in motor vehicles.

An object of the present invention is to provide a solenoid switch having a built-in time delay.

According to the present invention there is provided a solenoid switch comprising a coil, at least one fixed electrical contact, an armature movable relative to the coil, a movable electrical contact movable with the armature in a direction to engage the fixed contact, resilient means biasing the movable contact to a rest position relative to the armature, a member coupled to the armature through said resilient means for movement with the armature in the contact engagement direction, and a delay unit for slowing movement of the member in the contact engaging direction, the arrangement being such that in use, when the movable contact engages said fixed contact the armature moves relative to the member and the movable contact against the action of said resilient means thereby increasing contact pressure between the movable and fixed contacts.

Preferably the member takes the form of a sleeve within which the armature is slidable, said sleeve being provided at one end with a shoulder which engages the delay unit.

The delay unit may be a pneumatic delay unit comprising a chamber within which a plunger engaged by the member is slidable, the chamber having a wall defined by a diaphragm.

Conveniently the diaphragm of the delay unit can include a flap valve.

Figure 1:
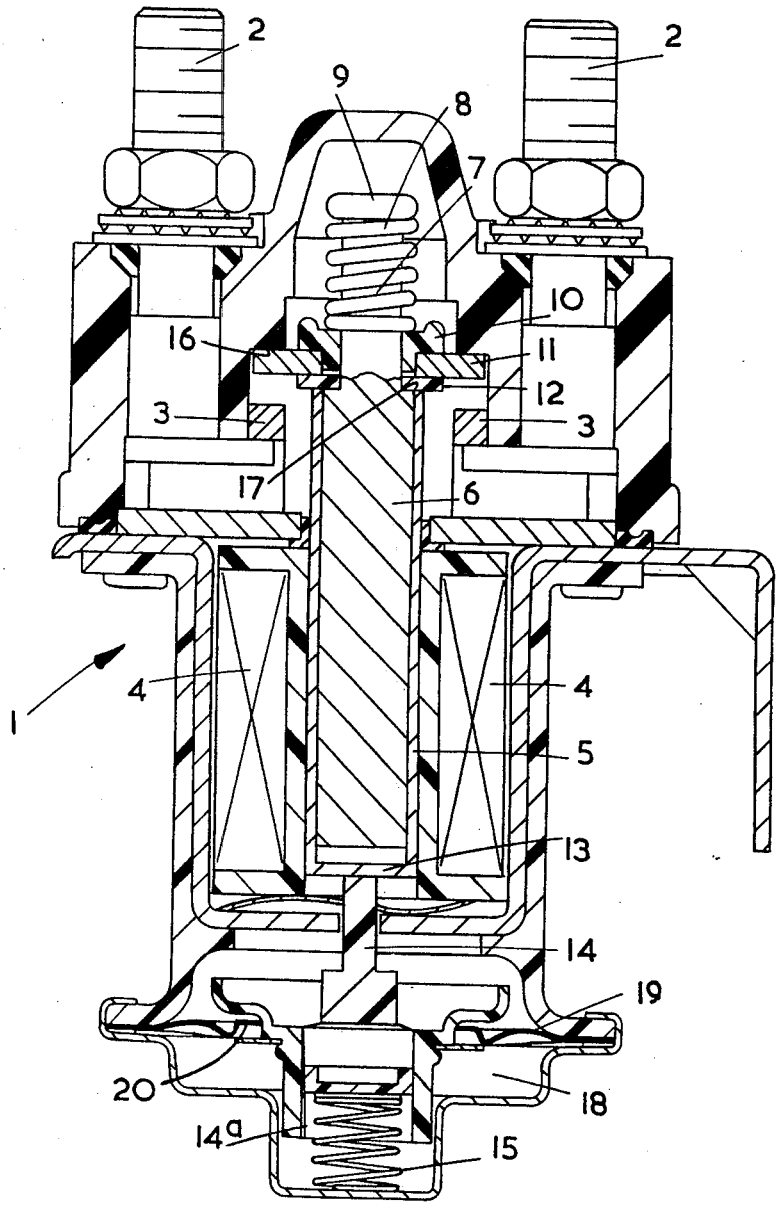
Figure 2:
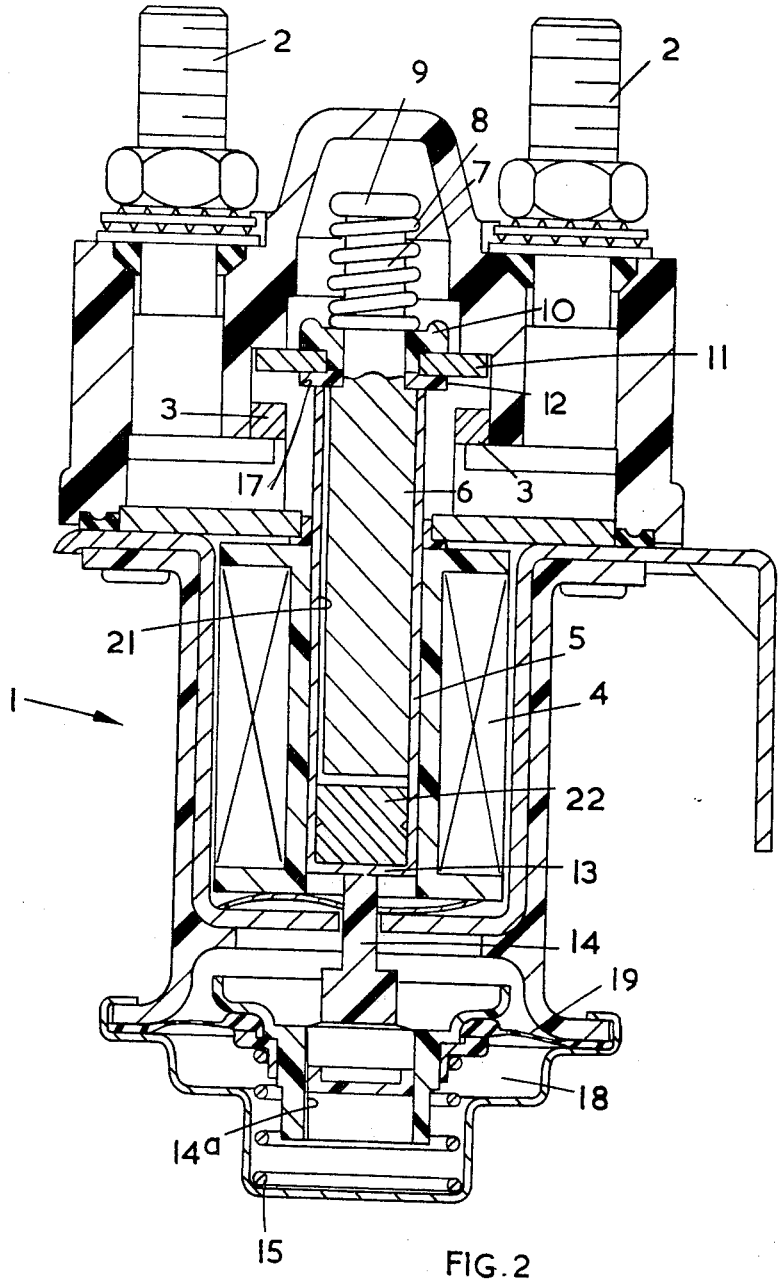

One example of the invention is illustrated in the accompanying drawings wherein:

FIG. 1 is a longitudinal sectional view of a solenoid switch for use in a starter motor circuit in a motor vehicle, and FIG. 2 is a view similar to FIG. 1 of a modification.

Referring to FIG. 1 of the drawings, the solenoid switch comprises a composite body 1 mounting a pair of terminals 2 each connected with a fixed contact 3. Within the body 1 is carried an annular coil 4 within which is mounted a sleeve 5 which is movable relative thereto. An armature 6 is mounted within the sleeve 5 to be movable relative thereto. A projection 7 on the armature 6 carries a coil spring 8 which is disposed between a shoulder 9 on the projection 7 and a collar 10 which traps an annular movable contact 11 and a washer 12 against a shoulder 17 on the armature.

The end of the sleeve 5 remote from the movable contact 11 is closed to provide a shoulder 13 against which a plunger 14 is urged by a return spring 15. The sleeve abuts the washer 12 and so the return spring 15 acts in a direction to urge the movable contact 11 out of engagement with the fixed contacts 3 and into abutment with a shoulder 16 on the body 1. In this position, the end of the armature 6 remote from the projection 7 is spaced from the end wall of the member 5 defining the shoulder 13.

The plunger 14 extends into a chamber 18 within which spring 15 is located. One wall of the chamber 18 is constituted by a flexible diaphragm 19 incorporating a flap valve 20.

In use, with the sleeve 5 and armature 6 in the position shown in the drawing, when the coil 4 is energised, the armature 6 is drawn further into the coil 4, i.e. downwardly in the drawing, and the spring 8 being stronger than the spring 15, causes the sleeve 5 and the movable contact 11 to be moved therewith so that the movable contact 11 is moved towards the fixed contacts 3. Movement of the sleeve 5 causes movement of the plunger 14 against the action of the spring 15. Movement of the plunger 14 effects movement of the diaphragm 19 in a direction to increase the pressure in the chamber 18, flap valve 20 being closed during such movement. An increase in the pressure chamber 18 slows down movement of the sleeve 5 and armature 6 so that the assembly of chamber 18, diaphragm 19 and plunger 14 acts as a pneumatic delay unit. During the application of pressure to the chamber 18, an air bleed via a passage **14*a* in the plunger 14 allows air to leak from chamber 18 whereby a constant resistance to movement of the sleeve 5 is presented by the pneumatic delay unit. When the movable contact 11 engages the fixed contacts 3 so as to bridge them, the drive coupling by way of the spring 8 between the armature and the sleeve is effectively broken and so movement of the sleeve stops. However, the armature 6 continues to move relative to the sleeve 5, compressing the spring 8, until the armature abuts the internal surface of the end wall defining the shoulder 13 on the member 5. Thus further movement of the armature 6 causing compression of the spring 8 thus increases the contact pressure between the movable contact 11 and the fixed contacts 3 so that the electrical connection therebetween is improved, the increase in contact pressure being applied rapidly since the armature is not impeded by the delay unit. When the coil 4 is de-energised, the increased contact pressure between the movable contact 11 and the fixed contacts 3 is removed due to movement of the armature 6 relative to the sleeve 5 and the movable contact under the action of spring 8. The armature gains inertia during this movement and engagement of the shoulder 17 with the washer 12 cause a rapid opening of the contacts minimising the possibility of arcing. Following this, the return spring 15 causes the assembly of member 5 and armature 6 to be moved back into the position shown in the drawing so that the movable contact 11 is brought into engagement with the shoulder 16. During the return movement of plunger 14, flap valve 20 opens to permit ready passage of air into chamber 18** so that the return movement of the sleeve is not delayed.

In the modification shown in FIG. 2 components common to the components of FIG. 1 are indicated by the same reference numerals. The principal distinctions are as follows. The flap valve 20 of the FIG. 1 example is omitted. The result of this is that the plunger 14 of the delay unit returns more slowly to its rest position after de-energisation of the coil 4. The diaphragm 19 seals the chamber 18 from atmosphere, by being adhesively bonded to both the body of the solenoid, and also the body of the delay unit. A clearance 21 is provided between the outer surface of the armature 6 and the inner surface of the sleeve 5 to allow free flow of air within the sleeve 5 as the plunger 6 moves relative to the sleeve 5. Thus the plunger 6 can move freely within the sleeve 5 during the conditions where relative movement takes place. By comparison with the arrangement shown in FIG. 1, the armature 6 is shortened, and a mild steel block 22 is trapped at the closed end of the sleeve 5. The shortening of the armature 6 and the provision of the block 22 modifies the magnetic circuit of the solenoid so that the air gap in the magnetic circuit occurs nearer to the central plane of the coil 4. It is of course this air gap which is taken up during relative movement between the sleeve 5 and the armature 6 in compressing the spring 8 after closure of the contacts 11, 3. The operation of the modified solenoid switch shown in FIG. 2 is identical to that described with reference to FIG. 1.

In the above described embodiment, the sleeve 5 is, for convenience, formed of mild steel. However, it is within the scope of the present invention to provide a sleeve 5 which is formed froma non-magnetic material, e.g., aluminium, brass or plastics.

It will be appreciated from the above that the solenoid switch provides a definite time delay between energisation of the coil 4 and closing of the contacts 11 and 3 and that an effective contact pressure is provided between the movable contact 11 and the fixed contacts 3.

I claim:

1. A solenoid switch comprising a body, a solenoid coil carried by the body, a fixed electrical contact carried by the body, a solenoid armature movable relative to the coil, a movable electrical contact carried by said armature, and movable therewith in response to energisation of said coil, in a direction to engage said fixed contact, resilient means carried by said armature, and acting on said movable contact to urge said movable contact to a rest position relative to said armature, a sleeve slidably receiving said armature, said sleeve being movable relative to said coil with said armature, said sleeve being coupled to said armature by way of said resilient means for movement with the armature in the contact engagement direction, and, a delay unit operatively associated with said sleeve, said delay unit slowing movement of said sleeve in the contact engaging direction, whereby, when said coil is energised, said sleeve and said armature move against the action of the delay unit in the contact engaging direction, and are slowed in their movement by the delay unit, whereas when said movable contact engages said fixed contact said armature moves relative to said sleeve and said movable contact against the action of said resilient means thereby rapidly increasing the contact pressure between said movable contact and said fixed contact.

2. A solenoid switch as claimed in claim 1 wherein said sleeve is provided at one end with a shoulder which engages the delay unit.

3. A solenoid switch as claimed in 1 wherein the delay unit is a pneumatic delay unit comprising a chamber within which a plunger engaged by said member is slidable, said chamber having a wall defined by a diaphragm coupled to said plunger.

4. A solenoid switch as claimed in claim 3 wherein said diaphragm includes a flap valve which opens during return movement of the plunger.

5. A solenoid switch as claimed in claim 1 wherein there are two fixed contacts which in use are bridged by the movable contact to complete an electrical circuit through the switch.

* * * * *